US009457933B2

(12) United States Patent
Van Gelder

(10) Patent No.: US 9,457,933 B2
(45) Date of Patent: Oct. 4, 2016

(54) HOLDER AND LIQUID CONTAINER ASSEMBLY

(75) Inventor: Peter Heinz Maria Van Gelder, Winssen (NL)

(73) Assignee: GVG OLIEHANDEL B.V. (NL)

( * ) Notice: Subject to any disclaimer, the term of this patent is extended or adjusted under 35 U.S.C. 154(b) by 0 days.

(21) Appl. No.: 14/240,289

(22) PCT Filed: Aug. 23, 2012

(86) PCT No.: PCT/NL2012/000058

§ 371 (c)(1),
(2), (4) Date: May 12, 2014

(87) PCT Pub. No.: WO2013/028065

PCT Pub. Date: Feb. 28, 2013

(65) Prior Publication Data

US 2014/0299615 A1 Oct. 9, 2014

(30) Foreign Application Priority Data

Aug. 23, 2011 (NL) ..... 2007290

(51) Int. Cl.

| | |
|---|---|
| ***B65D 25/22*** | (2006.01) |
| ***B65D 25/28*** | (2006.01) |
| ***B65D 25/48*** | (2006.01) |
| ***B65D 21/02*** | (2006.01) |
| ***A45F 5/10*** | (2006.01) |

(52) U.S. Cl.

CPC ..... *B65D 25/22* (2013.01); *A45F 5/10* (2013.01); *B65D 21/0201* (2013.01); *B65D 25/2894* (2013.01); *B65D 25/48* (2013.01)

(58) Field of Classification Search

CPC ..... A47J 47/00; A47J 47/02; A47J 47/16; A47B 73/00; A47B 73/006; A47B 73/008

USPC ..... 220/737, 8, 740, 212.5, 318, 752, 756, 220/768, 324; 211/71.01, 74, 76, 80, 82

See application file for complete search history.

(56) References Cited

U.S. PATENT DOCUMENTS

| | | | | |
|---|---|---|---|---|
| 1,771,106 | A | | 7/1930 | Wright |
| 3,648,830 | A | * | 3/1972 | Graf ..... 206/544 |
| 3,794,235 | A | | 2/1974 | Flider |
| 5,400,928 | A | | 3/1995 | Resnick |

(Continued)

FOREIGN PATENT DOCUMENTS

| | | |
|---|---|---|
| DE | 3032184 A1 | 4/1982 |
| DE | 202010009033 U1 | 8/2010 |

(Continued)

OTHER PUBLICATIONS

International Search Report and Written Opinion mailed Dec. 6, 2012 (PCT/NL2012/000058); ISA/EP.

IPRP Chapter II mailed Dec. 3, 2013 (PCT/NL2012/000058); ISA/EP.

*Primary Examiner* — Robert J Hicks
*Assistant Examiner* — Kareen Thomas
(74) *Attorney, Agent, or Firm* — Banner & Witcoff, Ltd.

(57) ABSTRACT

A holder for a liquid container, and an assembly of such a holder and a liquid container. The liquid container can be clamped or enclosed in the holder by a closing part which comprises a pouring spout which can be connected or is connected to a filling opening of the liquid container.

20 Claims, 4 Drawing Sheets

(56) References Cited

U.S. PATENT DOCUMENTS

| | | | | |
|---|---|---|---|---|
| 5,505,347 | A | 4/1996 | Roma | |
| 6,168,051 | B1 * | 1/2001 | Poppell | 222/209 |
| 7,344,116 | B2 * | 3/2008 | Ficarra et al. | 248/311.2 |
| 2007/0295768 | A1 | 12/2007 | Gringer et al. | |
| 2008/0012368 | A1 * | 1/2008 | Kent-Fawkes | A47G 23/0258 294/29 |

FOREIGN PATENT DOCUMENTS

| | | | |
|---|---|---|---|
| FR | 958694 | A | 3/1950 |
| GB | 905900 | A | 9/1962 |
| GB | 2238771 | A | 6/1991 |

* cited by examiner

HOLDER AND LIQUID CONTAINER ASSEMBLY

The present application is a U.S. National Phase filing of International Application No. PCT/NL2012/000058, filed on Aug. 23, 2012, designating the United States of America and claiming priority to and the benefit of NL 2007290, filed Aug. 23, 2011. The present application claims priority to and the benefit of the above-identified applications, and the above-identified applications are incorporated by reference herein in their entirety.

The present invention relates to a holder for a liquid container. The invention also relates to a holder suitable for holding a liquid container.

Such a holder is known and already commercially available. An example of such a holder is shown in FIG. 1. The known holder 1 comprises a frame with an upright 2 which is provided on an upper side with a closing part 3 pivotally connected to upright 2. Closing part 3 can be operated by means of a handle 4. Holder 1 can be used to clamp a liquid container 5, in particular to clamp jerrycans. Liquid container 5 is provided with a filling opening 6 for filling and emptying liquid container 5. Filling opening 6 is usually provided with a screw thread, whereby it can be closed in known manner with a cap 10.

Closing part 3 and upright 2 together define a space in which liquid container 5 can be placed. For this purpose upright 2 is provided on an underside with a clamp 7. A liquid container 5 can be clamped in the space by operating handle 4. Closing part 3 will hereby move from a second state to a first state in which it will grip liquid container 5.

Holder 1 is fixedly connected on a rear side to a further liquid container 8. Using holder 1 it thus becomes possible to provide a transportable system comprising two different liquids. A possible application of holder 1 is in forestry. Frequent use is made in forestry of chain-saw machines which have to be provided with petrol as fuel, and which also have to be regularly lubricated with lubricating oil. Using the known holder 1 the petrol can for instance be transported in liquid container 5 while the lubricant is in the further liquid container 8. A user therefore has a single holder to transport instead of two different containers.

The known holder does however have a number of drawbacks. A first drawback is related to pouring of the liquid present in liquid container 5. Holder 1 is for this purpose gripped by handgrip 9 of liquid container 5, after which holder 1 is brought into the desired position. However, because handle 4 of holder 1 extends a considerable distance above liquid container 5, pouring is made more difficult in some situations because handle 4 comes into contact with the apparatus which has to be refilled.

Another drawback is related to the contamination of liquid present in liquid container 5. Before a user can use the known holder 1 to refill an apparatus, the user has to attach a pouring spout to filling opening 6 of liquid container 5. After use the pouring spout has to be removed, after which liquid container 5 can once again be closed with cap 10. Unlike cap 10, the pouring spout is not easy to clean. This results in the danger that, during the change-over, the pouring spout becomes soiled in a manner such that this results in a contamination of the liquid in liquid container 5 or of the liquid in the apparatus being refilled. This is also related to the fact that holder 1 is usually used in non-sterile situations wherein the placing of the pouring spout on for instance a ground surface can easily result in contamination with sand or dust.

A further drawback of the known holder 1 is that the further liquid container 8 is fixedly connected to holder 1. It is hereby not easily possible to exchange liquid container and/or attach other aids such as tools to holder 1.

An object of the present invention is to provide an assembly comprising a liquid container with a filling opening for filling and emptying the liquid container, and a holder for the liquid container wherein at least one of the above stated drawbacks does not occur, or hardly so.

The assembly according to the invention is characterized in that the closing part comprises a pouring spout which in the first state can be connected or is connected to the filling opening. Because the pouring spout is incorporated in the closing part, two advantages are gained at the same time. On the one hand the closing part provides for gripping and holding of the liquid container, and on the other soiling of the pouring spout attached to the closing part, for instance by contact with the ground, is prevented. Connection of the pouring spout to the liquid container also provides for a further clamping and/or confining function.

In an embodiment of the present invention the liquid container is a jerrycan. The liquid container is more particularly a plastic jerrycan. It is recommended for all embodiments of the liquid container that the filling opening is placed on the upper side of the container.

In an embodiment of the present invention the pouring spout and the filling opening are each provided with coupling means which can co-act in the first state for the purpose of connecting the pouring spout to the filling opening. The pouring spout and filling opening are for this purpose usually each provided with mutually adapted screw thread.

In an embodiment of the present invention the closing part further comprises a first clamping part which is pivotally connected on a side to the frame and pivotally connected on another side to the pouring spout. A length of the first clamping part can be adapted here to a position of the filling opening such that during movement from the second state to the first state the pouring spout is brought into a position in which it can engage or does engage the filling opening. It is further possible to embody the first clamping part such that in the first state it clamps the liquid container in the holder or approaches the container very closely. Within the context of the present invention approaching very closely should be interpreted as being an approach which prevents a significant displacement of the liquid container in the holder—which could cause problems during pouring—since the first clamping part forms a stop for the liquid container.

In a further embodiment of the present invention the liquid container is provided with a handgrip of a predetermined form, wherein the first clamping part is embodied such that in the first state it at least partially follows and/or encloses the form of the handgrip. As a result of this measure the first clamping part will clamp the liquid container or approach it very closely at the position of the handgrip of the liquid container.

In yet another embodiment of the present invention the first clamping part and the handgrip of the liquid container are embodied such that in the first state they form a handle which enables a user to transport the assembly, preferably by means of simultaneously gripping the first clamping part and the handgrip. This is for instance possible because the first clamping part matches or at least partially encloses the handgrip of the liquid container, this in a manner such that a user can place his/her fingers simultaneously round the first clamping part and the handgrip of the liquid container.

A further advantage hereof is that it is possible to avoid the holder coming into contact with the apparatus for refilling during pouring.

In an embodiment of the present invention the frame comprises a bottom part and an upright connected thereto, wherein the first clamping part is pivotally connected to the upright at an end of the upright remote from the bottom part. The upright is generally placed vertically here. The combination of upright, closing part and bottom part defines a C-shaped or tilted U-shaped space in which the liquid container can be received. In a further embodiment of the present invention the frame comprises a further upright which is placed opposite said upright and between which the opening is defined. It hereby becomes possible to enclose the liquid container on four sides. Such a confinement can be reinforced when the closing part comprises a further clamping part which can be coupled on a side to the further upright and is coupled pivotally on another side to the pouring spout. The further upright and the further clamping part can be provided for this purpose with co-acting coupling means.

In an embodiment of the present invention the filling opening of the liquid container lies closer to a first edge of the liquid container than to an opposite second edge. The holder is embodied here for the purpose of receiving the liquid container in a position wherein the second edge lies closer to the upright than the first edge. Owing to this positioning of the filling opening and the associated positioning of the liquid container in the holder it is possible to further avoid the holder coming into contact with the apparatus for refilling during pouring.

In an embodiment of the present invention the bottom part is provided with a profiling and/or upright edges for clamping the liquid container. The liquid container will hereby not detach easily from the bottom part, even after uncoupling of the closing part. A user can thus place the holder, with a liquid container placed therein but not clamped by the closing part, on a non-flat ground surface without running the risk of the liquid container tipping over.

According to a second aspect, the present invention provides a holder suitable for holding a liquid container, wherein the holder is embodied as described above.

The invention will be discussed in more detail hereinbelow with reference to the accompanying figures, wherein.

Figure 1:
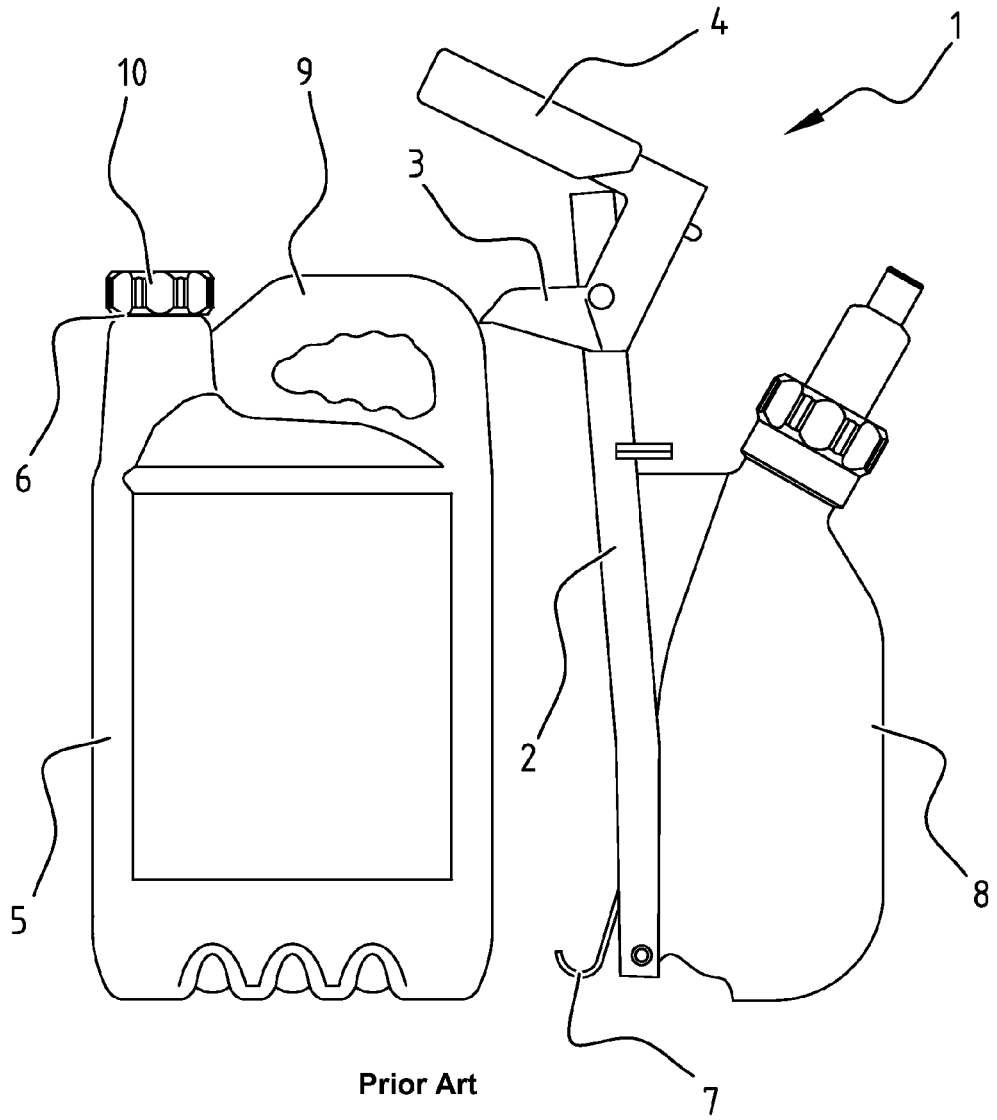
Prior Art FIG. 1
FIG. 1 shows a known holder.
Figure 2:
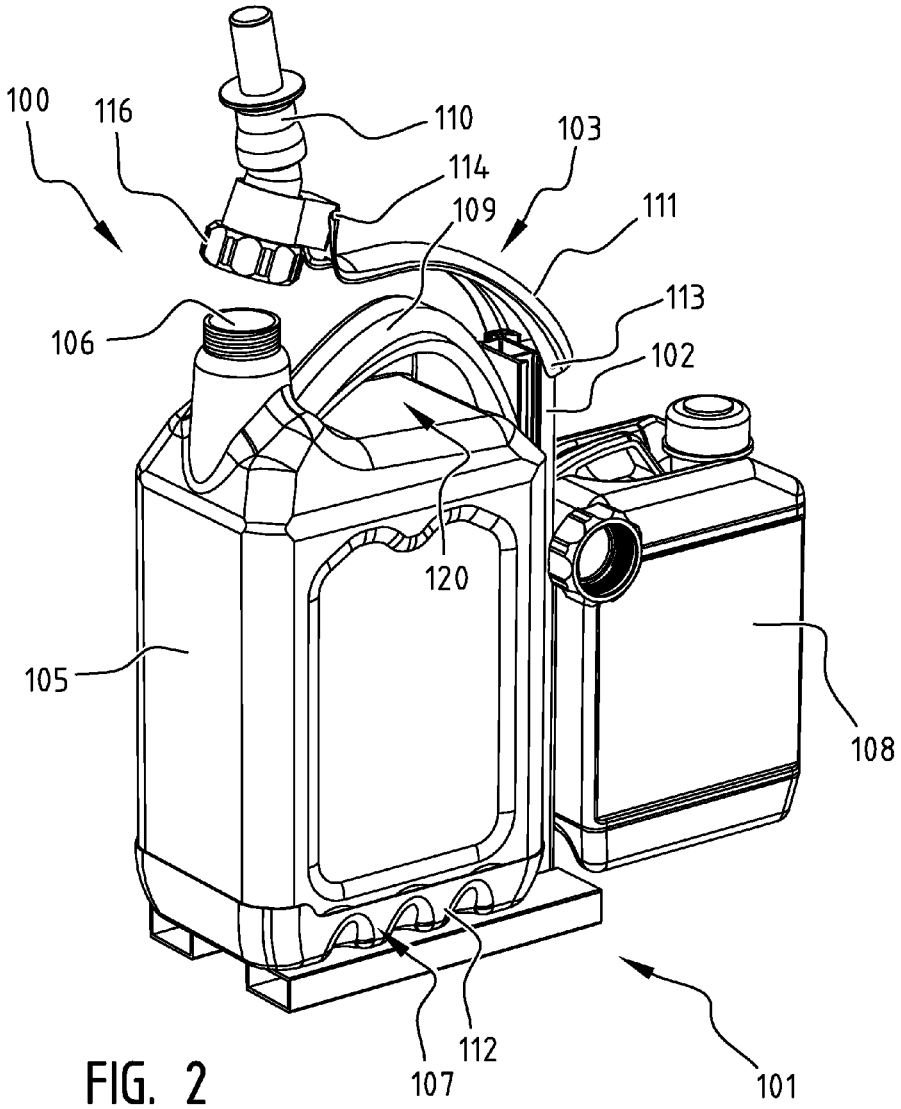
FIG. 2 shows an embodiment of the present invention wherein a liquid container is placed in the holder but is not yet clamped therein.

FIG. 2 shows an embodiment of an assembly 100 according to the present invention. Assembly 100 comprises a holder 101 and a liquid container 105 in the form of a jerrycan with filling opening 106.

Holder 101 comprises a bottom part 107 provided with profile upright edges 112. Liquid container 105 can hereby be clamped in bottom part 107. Holder 101 further comprises an upright 102 which is connected pivotally on an upper side to a closing part 103. This closing part comprises a pouring spout 110 which is connected pivotally to a first clamping part 111. Holder 101 is coupled on the rear side to a further liquid container 108.

FIG. 2 shows closing part 103 in the second state. In this state liquid container 105 can be removed from holder 101. In order to enclose and/or clamp the liquid container 105 closing part 103 must be moved to the first state. This movement is possible by means of a hinge 113 between first clamping part 111 and upright 102 and a hinge 114 between first clamping part 111 and pouring spout 110. Closing part 103 is first pivoted here such that pouring spout 110 moves into a position in which it can engage filling opening 106, for instance in that a screw thread of pouring spout 110 is properly aligned relative to the screw thread of filling opening 106. The coupling between closing part 103 and liquid container 105 can then be completed, for instance by rotating the ring 116 over the screw thread of filling opening 106. Thus reached is the situation as shown in FIG. 3.

It should be noted that hinge 114 is not essential for every embodiment of the invention. Depending on the method of coupling between pouring spout 110 and filling opening 106 and the design of first clamping part 111, hinge 114 can be replaced by a rigid connection.

Figure 3:
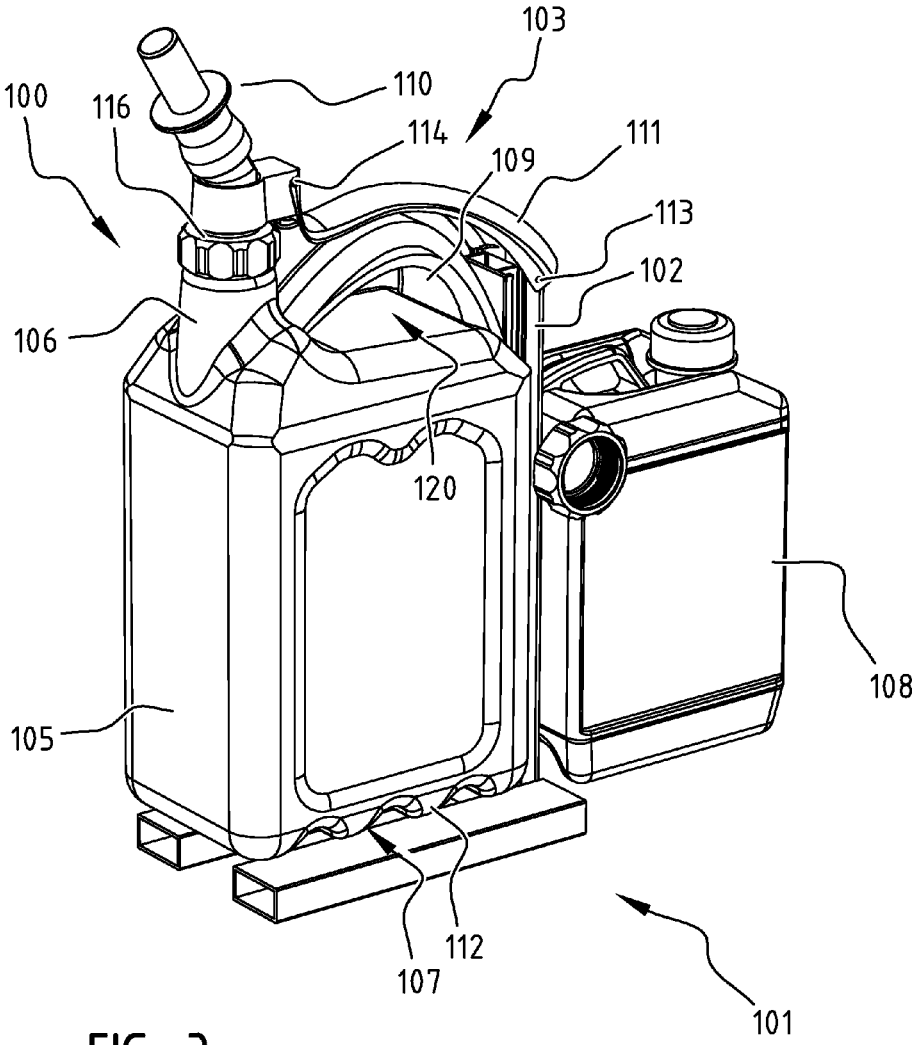
FIG. 3 shows the embodiment of FIG. 2 wherein the liquid container is clamped in the holder.

As shown in FIG. 3, there is a good match between first clamping part 111 and handgrip 109 of liquid container 105 matched. Because first clamping part 111 engages handgrip 109, or approaches it very closely, two advantages are gained. On the one hand first clamping part 111 in combination with pouring spout 110 encloses liquid container 105 in the space between first clamping part 111, bottom part 107 and upright 102, while on the other first clamping part 111 provides together with handgrip 109 a combined handle for the user in that first clamping part 111 and handgrip 109 can be gripped simultaneously by the user when he or she places his or her fingers through opening 120.

Figure 4:
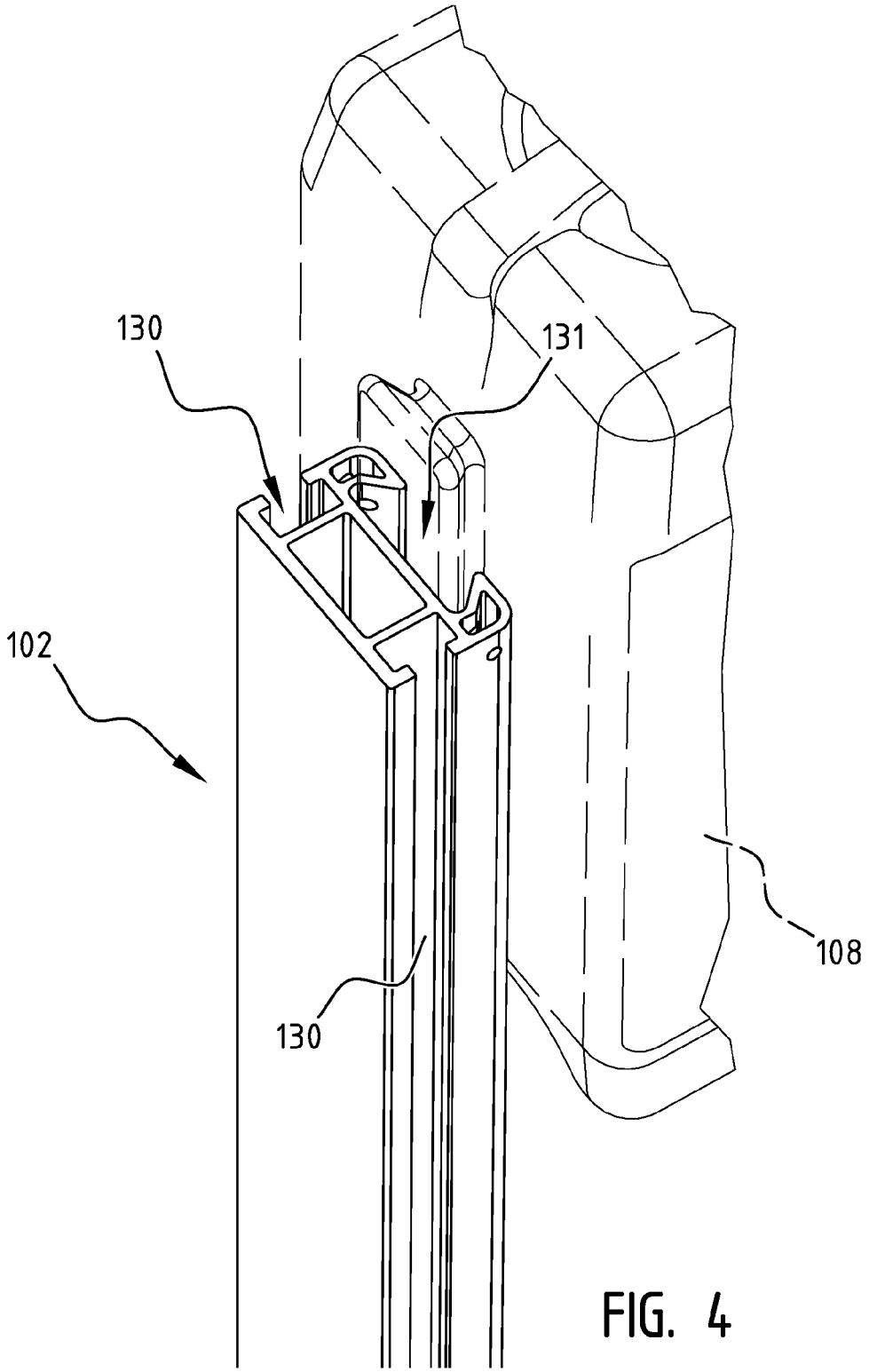
FIG. 4 shows a rear view of a part of the upright of the embodiment of FIG. 2.

FIG. 4 shows a rear view of a part of upright 102. This preferably takes the form of a hollow extrusion or injection-moulded profile and has on the side T-shaped slots 130, thereby creating additional attachment options. Accessories can be arranged herein on the side of the upright at any desired height by means of attachment aids. It is possible here to envisage supports for securing the original cap of liquid container 105 or additional accessories required when working with holder 101. It is possible to easily switch accessories using these slots so that the multifunctionality of holder 101 remains ensured.

Present on the rear side of upright 102 is a roughly V-shaped slot 131 with which further liquid container 108 can be placed and fixed directly in upright 102. Further liquid container 108 is provided for this purpose with a profile which can co-act with V-shaped slot 131.

In the above description the invention is discussed with reference to embodiments and other aspects of the invention. It will be apparent to the skilled person that various changes to these embodiments are possible without departing from the scope of protection of the invention defined by the following claims.

The invention claimed is:

1. An assembly comprising:

a liquid fuel container with a filling opening for filling and emptying the liquid fuel container; and a holder for the liquid fuel container, said holder comprising:

a frame defining an opening in which the liquid fuel container can be placed;

a closing part connected pivotally to the frame, wherein the closing part is movable between a first state, in which the closing part grips and holds fast the liquid fuel container placed in the opening of the frame, and a second state in which the liquid fuel container can be removed from the frame;

wherein the closing part comprises a pouring spout which in the first state can be connected or is connected to the filling opening;

wherein the closing part further comprises a first clamping part which is pivotally connected on a side to the frame and pivotally or rigidly connected on another side to the pouring spout;

wherein a length of the first clamping part is adapted to a position of the filling opening such that during movement from the second state to the first state the pouring spout is brought into a position in which the pouring spout can engage or does engage the filling opening;

wherein the frame comprises a bottom part and an upright connected thereto, wherein the first clamping part is pivotally connected to the upright at an end of the upright remote from the bottom part;

wherein the bottom part is provided with a profiling and/or upright edges for clamping the liquid fuel container configured such that the liquid fuel container will not detach easily from the bottom part, even after uncoupling of the closing part.

2. The assembly as claimed in claim 1, wherein the liquid fuel container is a jerrycan.

3. The assembly as claimed in claim 1, wherein the pouring spout and the filling opening are each provided with coupling means which can co-act in the first state for the purpose of connecting the pouring spout to the filling opening.

4. The assembly as claimed in claim 1, wherein in the first state the first clamping part clamps the liquid fuel container in the holder or approaches the liquid fuel container very closely.

5. The assembly as claimed in claim 4, wherein the liquid fuel container is provided with a handgrip of a predetermined form, wherein the first clamping part is embodied such that in the first state it at least partially follows and/or encloses the form of the handgrip.

6. The assembly as claimed in claim 1, wherein the frame comprises a further upright which is placed opposite the upright and between which the opening is defined.

7. The assembly as claimed in claim 1, wherein the filling opening of the liquid fuel container lies closer to a first edge of the liquid fuel container than to an opposite second edge, wherein the holder is embodied for the purpose of receiving the liquid fuel container in a position wherein the second edge lies closer to the upright than the first edge.

8. A holder suitable for holding a liquid fuel container, said liquid fuel container comprising a filling opening for filling and emptying the liquid fuel container, said holder comprising:

a frame defining an opening in which the liquid fuel container can be placed;

a closing part connected pivotally to the frame, wherein the closing part is movable between a first state, in which the closing part grips and holds fast the liquid fuel container placed in the opening of the frame, and a second state in which the liquid fuel container can be removed from the frame;

wherein the closing part comprises a pouring spout which in the first state can be connected or is connected to the filling opening;

wherein the closing part further comprises a first clamping part which is pivotally connected on a side to the frame and pivotally or rigidly connected on another side to the pouring spout;

wherein a length of the first clamping part is adapted to a position of the filling opening such that during movement from the second state to the first state the pouring spout is brought into a position in which the pouring spout can engage or does engage the filling opening;

wherein the frame comprises a bottom part and an upright connected thereto, wherein the first clamping part is pivotally connected to the upright at an end of the upright remote from the bottom part;

wherein the bottom part is provided with a profiling and/or upright edges for clamping the liquid fuel container configured such that the liquid fuel container will not detach easily from the bottom part, even after uncoupling of the closing part.

9. The holder as claimed in claim 8, wherein the pouring spout and the filling opening are each provided with coupling means which can co-act in the first state for the purpose of connecting the pouring spout to the filling opening.

10. The holder as claimed in claim 9, wherein the coupling means comprise screw threads.

11. The holder as claimed in claim 10, wherein the pouring spout comprises a ring that is configured to allow the screw threads of the pouring spout and the filling opening to be mutually connected in the first state by rotating the ring over the screw threads of the filling opening.

12. The holder as claimed in claim 8, wherein in the first state the first clamping part clamps the liquid fuel container in the holder or approaches the liquid fuel container very closely.

13. The holder as claimed in claim 12, wherein the liquid fuel container is provided with a handgrip of a predetermined form, wherein the first clamping part is embodied such that in the first state it at least partially follows and/or encloses the form of the handgrip.

14. The holder as claimed in claim 13, wherein the first clamping part and the handgrip of the liquid fuel container are embodied such that in the first state they together form a handle which enables a user to transport the holder and liquid fuel container.

15. The holder as claimed in claim 14, wherein the first clamping part and the handgrip of the liquid fuel container are embodied such that in the first state they together form a handle which enables a user to transport the holder and liquid fuel container by simultaneously gripping the first clamping part and the handgrip.

16. The holder as claimed in claim 8, wherein the frame comprises a further upright which is placed opposite the upright and between which the opening is defined.

17. The holder as claimed in claim 16, wherein the closing part comprises a further clamping part which can be coupled on a side to the further upright and is coupled pivotally on another side to the pouring spout.

18. The holder as claimed in claim 17, wherein the filling opening of the liquid fuel container lies closer to a first edge of the liquid fuel container than to an opposite second edge, wherein the holder is embodied for the purpose of receiving the liquid fuel container in a position wherein the second edge lies closer to the upright than the first edge.

19. The holder as claimed in claim 8, wherein the filling opening of the liquid fuel container lies closer to a first edge of the liquid fuel container than to an opposite second edge, wherein the holder is embodied for the purpose of receiving the liquid fuel container in a position wherein the second edge lies closer to the upright than the first edge.

20. The holder as claimed in claim 16, wherein the filling opening of the liquid fuel container lies closer to a first edge of the liquid fuel container than to an opposite second edge, wherein the holder is embodied for the purpose of receiving the liquid fuel container in a position wherein the second edge lies closer to the upright than the first edge.

* * * * *